United States Patent [19]

Wlodkowski et al.

[11] 4,343,122

[45] Aug. 10, 1982

[54] SYSTEM FOR ANCHORING A TENDON IN A STRUCTURAL CONCRETE UNIT

[75] Inventors: Johann Wlodkowski; Dieter Jungwirth, both of Munich, Fed. Rep. of Germany

[73] Assignee: Dyckerhoff & Widmann Aktiengesellschaft, Munich, Fed. Rep. of Germany

[21] Appl. No.: 227,596

[22] Filed: Jan. 23, 1981

[30] Foreign Application Priority Data

Jan. 26, 1980 [DE] Fed. Rep. of Germany ... 8002044[U]

[51] Int. Cl.[3] ..... E04C 5/12

[52] U.S. Cl. ..... 52/223 L

[58] Field of Search ..... 52/223 R, 223 L, 230

[56] References Cited

U.S. PATENT DOCUMENTS 2,941,394 6/1960 Brandt ..... 52/223 R
3,703,748 11/1972 Kelly ..... 52/223 L

FOREIGN PATENT DOCUMENTS 482080 1/1970 Switzerland ..... 52/230
1127337 9/1968 United Kingdom ..... 52/223 L

*Primary Examiner*—James L. Ridgill, Jr.
*Attorney, Agent, or Firm*—Toren, McGeady & Stanger

[57] ABSTRACT

In a system for anchoring a tendon extending through a structural concrete unit, an anchoring member is located at the outside surface of the concrete unit and has a frusto-conical passage through which a tendon passes as it extends outwardly from the concrete unit. A cap fits over the outer surface of the anchoring member and forms a closure over its frusto-conical passage. The cap is shaped so that it has an inwardly projecting portion which seats against the outer ends of wedge parts securing the tendon within the passage in the anchoring member. The projection on the cap exerts a compressive force holding the wedge parts in place. Further, during construction of the concrete unit, the cap can secure the wedge parts against displacement.

8 Claims, 4 Drawing Figures

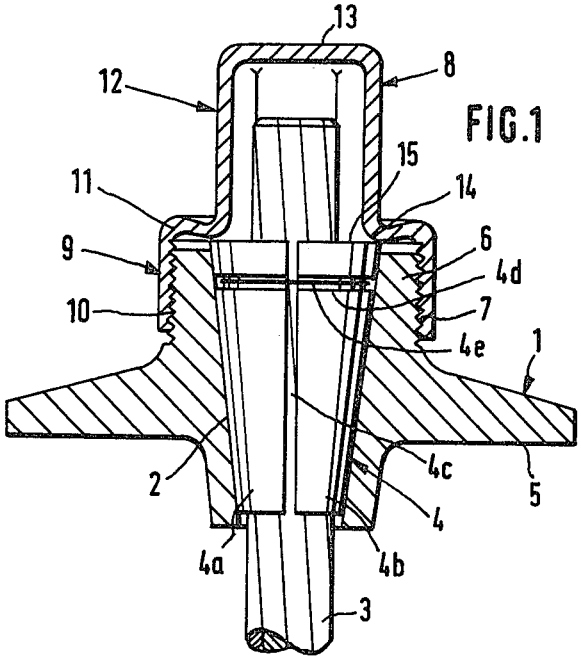
FIG.1
FIG.4
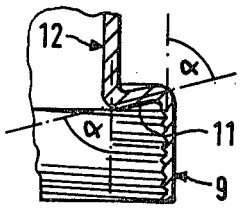
FIG.2
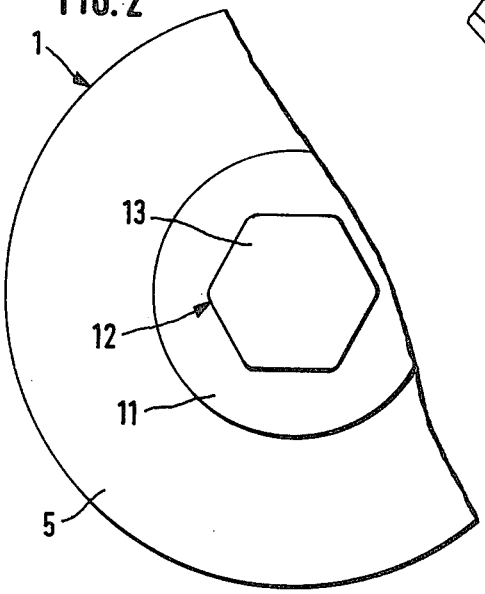
FIG.3
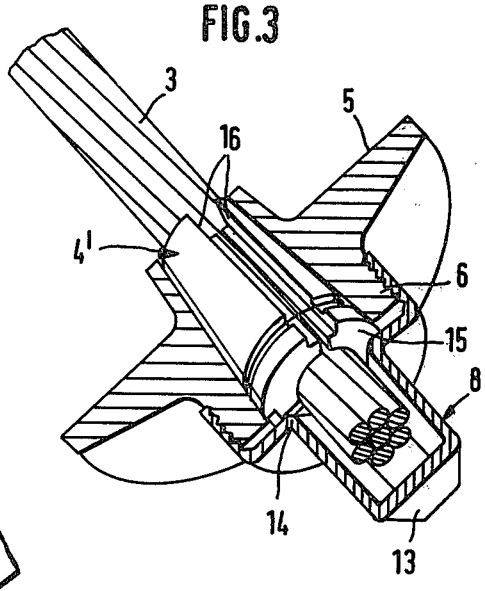

SYSTEM FOR ANCHORING A TENDON IN A STRUCTURAL CONCRETE UNIT

SUMMARY OF THE INVENTION

The present invention is directed to a system for wedge anchoring a tendon in a structural concrete unit with an anchoring member bearing against the concrete unit and forming a central frusto-conical passage for the tendon. The frusto-conical passage widens in the direction outwardly from the concrete unit and forms a seating surface for the wedge parts which secure the tendon. The outer end of the passage can be closed by a cap secured to the anchoring member in a form-locking manner. The cap is formed so that, when it is connected to the anchoring member, it exerts a compressive force on the end faces of the wedge parts facing outwardly away from the concrete unit.

In anchorage systems in which the tendons are tensioned only from one end, it is necessary to secure the wedge parts against any possible accidental separation at the ends which are fixed in concrete, that is, at the ends which are not tensioned. In tendons where, after the tensioning has been effected, there is no bond created between the tendon and the concrete surrounding it, such as by injecting neat cement or grout into the prestressing duct, it is necessary to protect the end of the tendons which project outwardly from the anchoring members against corrosion.

In a known wedge anchoring system, the anchoring member has a cylindrical attachment with an internal thread on the side from which the tendon bends, that is the side facing outwardly away from the concrete unit. A cap with an external thread is screwed into the cylindrical attachment, note Swiss Pat. No. 482,080. A helical spring is located in the interior of the cap and the spring slides over the end of the tendon which projects outwardly from the wedge parts. When the cap is screwed into the attachment, the spring passes against the cover formed by the cap and the outwardly facing end surfaces of the wedge parts to fix the wedge parts in place. This cap is encased in concrete, that is, it is not accessible. In tendons without any bond, the cap can be filled with a corrosion protecting substance.

In practice, it is attempted to construct the parts which are fixed in place, that is, which are not accessible, in a simple and economic manner and also in a way that is as effective as possible. Therefore, the primary object of the present invention is to provide a wedge anchoring system of this type including a cap for fixing the wedge parts and for providing corrosion protection of the anchoring system in a simpler and more economical manner and in a way that is more effective than the known cap arrangement.

In accordance with the present invention, the cap is shaped so that inwardly extending projections are formed which contact the ends of the wedge parts when the cap is connected to the anchoring member.

The lateral wall of the cap intermediate its transverse ends is bent approximately at right angles to provide a smaller diameter part toward its outer closed end. This diameter reduction provides a shoulder within the cap which contacts the outer end of the wedge parts. Due to the angular relation of the bent portion forming the shoulder with respect to the axially extending portions of the cap, wall angles slightly smaller than 90° are formed.

The outer or smaller diameter end of the cap is preferably provided with a polygonal and in particular a hexagonally shaped circumferential surface.

The larger diameter end of the cap, that is, the end which fits over the anchoring member, is provided with an internal thread which can be screwed on to a corresponding external thread on the anchoring member. Advantageously, the cap is formed as a deep-drawn component of metal, plastics material or the like.

The basic advantage of the wedge anchoring system embodying the present invention involves the shaping of the cap so that it is unnecessary to use a compression spring. As a result, where in the past two parts were required for fixing the wedge parts in position, with the present invention only one part is needed. In the arrangement of the present invention, however, a certain spring effect is still present because the special construction of the inwardly bent portion of the cap makes it possible to provide a certain resilience to the shoulder which fixes the wedge parts in place. Since the cap externally engages a cylindrical portion of the anchoring member it is possible to provide an improved closure for the outwardly facing end of the anchoring member and to afford a more effective corrosion protection.

The various features of novelty which characterize the invention are pointed out with particularly in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 1 is an axially extending sectional view through a wedge anchoring system including a cap, embodying the present invention;

FIG. 2 is a partial end view of the anchoring system including the cap as illustrated in FIG. 1;

FIG. 3 is a perspective view, partly in section, of the wedge anchoring system illustrated in FIG. 1; and FIG. 4 is an enlarged detail of a portion of the cap illustrated in FIG. 1.

DETAIL DESCRIPTION OF THE INVENTION

As shown in the drawings, the wedge anchoring system includes an anchoring member 1 having a central frusto-conical passage for a tendon which is illustrated as a strand 3. Instead of a strand, however, it is also possible to use a wire or a rod as the tendon. The central passage 2 conically widens outwardly from a structural concrete unit, not shown, and forms the seating surface for a complementary shaped tapered collar 4. The tapered collar which is not the subject matter of the present invention, is made up of two or three individual parts *4a*, *4b* each of which extends around the axis of the passage 2 for an angle of 180° or 120°, respectively. With the exception of narrow axially extending slots *4c*, the parts form a closed annular cross section around the tendon. Extending circumferentially around the outer surface of the individual parts *4a*, *4b* is a groove *4d* in which a spring ring *4e* is fitted to hold the parts together. The anchoring member includes a flange-like member or plate 5 for providing support relative to the structural concrete unit, not shown. As indicated in the drawing, the plate 5 has a circular circumferential periphery.

The anchoring member 1 has a cylindrical projection 6 which extends outwardly from the plate 5, that is, in the direction away from the structural concrete unit. The cylindrical projection 6 has an external thread 7 and the projection is characterized as the tensioning end of the anchoring member 1. A cap 8 has an internal thread 10 which is screwed on to external thread 7 on the cylindrical projection 6. As viewed in FIG. 1, the lower portion of the cap forms a larger diameter portion 9 while the upper portion forms a smaller diameter portion 12. A transversely extending bent portion 11 interconnects the larger diameter portion 9 with the smaller diameter portion 12. These two portions extend in the axial direction of the passage 2 through the anchoring member 1. The end of the smaller diameter portion 12 spaced outwardly from the anchoring member 1 has a closure cover 13. As can be seen in FIG. 2, the axially extending surface of the portion 12 has a hexogonal periphery so that it can be screwed on to the cylindrical projection 6 of the anchoring member 1 by means of a conventional wrench.

As can be seen in FIG. 1, the bent portion 11 extends transversely of the axial direction of the passage 2 and is arranged approximately perpendicularly of the larger diameter portion 9 and of the smaller diameter portion 12. The angle formed by the bent portion 11 with the two axially extending portions 9 and 12 is smaller than 90°, note FIG. 4. Preferably, the angle formed by the bent portion 11 with the axially extending portions 9, 12 is in the range of 70° to 80°. Because of the angular relation of the bent portion 11 with the axially extending portions 9, 12 an annular contact shoulder 14 is formed which presses against the outer end faces 15 of the parts of the tapered collar 4. As can be seen in FIGS. 1 and 4 the shoulder 14 projects toward the tapered collar 4 from a plane extending perpendicularly of the passage axis through the junction of the larger diameter portion 9 and the bent portion 11. Due to the elasticity inherent in the material used for the cap, the compressive force afforded by the shoulder 14 is determined by the extent to which the cap 8 is screwed on to cylindrical projection 6.

As can be seen in FIG. 3, tapered collar 4' has individual parts forming longitudinally extending recesses 16 in the outer surfaces of the parts along the axially extending slots 4c. The longitudinal groove is formed by two adjacent recesses 16 formed in the adjoining edges of two parts of the tapered collar. These recesses provide an axially extending groove through which neat cement, grout or a similar material can be passed into the annular duct formed between the strand 3 and the sheathing tube, not shown.

While specific embodiments of the invention have been shown and described in detail to illustrate the application of the inventive principles, it will be understood that the invention may be embodied otherwise without departing from such principles.

What is claimed is:

1. In a wedge anchoring system for anchoring a tendon extending through a structural concrete unit at a location where the tendon extends from the unit including an anchoring member arranged to bear against the concrete unit and having an axially extending central passage through which the tendon extends out of the concrete unit, the central passage through the anchoring member widens conically outwardly from the concrete unit and is arranged to form a frusto-conical seating surface for a wedge member arranged to grip the tendon, a cap elongated in the axial direction of the central passage and connectible to the anchoring member in a form-locking manner for forming a closure over the end of the anchoring member located outwardly away from the concrete unit, said cap arranged to exert a compressive force on the transverse ends of the wedge member facing outwardly away from the concrete member, wherein the improvement comprises that said cap having at least one inwardly directed projection formed integraly therewith and forming a surface within said cap extending transversely of the elongated axial direction thereof and arranged to extend into contacting engagement with the transverse ends of the wedge member facing outwardly away from the concrete member for affording the compressive force thereon.

2. In a wedge anchoring system, as set forth in claim 1, wherein said cap having an annular wall forming the elongated axially extending portion thereof, said annular wall having a larger diameter portion connectible to the anchoring member and a smaller diameter portion extending axially outwardly from the anchoring member and said annular wall being bent inwardly from the larger diameter portion to the smaller diameter portion with the inwardly bent portion forming a shoulder at the radially inner edge within said annular wall and said shoulder forming said at least one projection for contacting the transverse ends of the wedge member.

3. In a wedge anchoring system, as set forth in claim 2, wherein said bent portion forming an angle smaller than 90° with the larger diameter portion and the smaller diameter portion of said annular wall.

4. In a wedge anchoring system, as set forth in claim 3, wherein the smaller diameter portion of said annular wall having a polygonal shape transverse to the axial direction of the passage through the anchoring member.

5. In a wedge anchoring system, as set forth in claim 4, wherein the polygonally shaped smaller diameter portion of said annular wall being hexagonally shaped.

6. In a wedge anchoring system, as set forth in claim 4, wherein the larger diameter portion of said annular wall having an internal thread so that it can be screwed on to a corresponding external thread on said anchoring member.

7. In a wedge anchoring system, as set forth in claim 1, 2, 3, 4, 5 or 6 wherein said cap being formed as a deep-drawn component.

8. In a wedge anchoring system, as set forth in claim 7, wherein said deep drawn component being formed of one of metal and a plastics material.

* * * * *